United States Patent [19]

Walter et al.

[11] Patent Number: 4,613,062

[45] Date of Patent: Sep. 23, 1986

[54] HOT MELT MATERIAL DISPENSER

[75] Inventors: John Walter, Evergreen Park, Ill.; Donald J. Roth, Westport; Charles S. Kubis, Ewston, both of Conn.

[73] Assignee: Continental Can Company, Inc., Stamford, Conn.

[21] Appl. No.: 601,404

[22] Filed: Apr. 17, 1984

[51] Int. Cl.[4] ..... B67D 5/62

[52] U.S. Cl. ..... 222/146.2; 222/263; 74/128; 219/421; 226/11; 226/143

[58] Field of Search ..... 222/146.5, 146.2, 263; 118/410; 219/230; 226/49, 51, 11, 143; 74/128

[56] References Cited

U.S. PATENT DOCUMENTS

| | | | |
|---|---|---|---|
| 1,657,819 | 1/1928 | Cooper et al. | 222/263 X |
| 2,765,768 | 10/1956 | Paulsen | 222/146.5 X |
| 2,831,214 | 4/1958 | Eyles | 222/146.5 X |
| 2,966,291 | 12/1960 | Anderson | 226/11 X |
| 3,008,863 | 11/1961 | Morris et al. | 219/230 X |
| 3,232,509 | 2/1966 | Newton | 219/230 X |
| 3,285,475 | 11/1966 | Phillips | 219/230 X |
| 3,318,481 | 5/1967 | Phillips et al. | 222/146.2 X |
| 3,653,552 | 4/1972 | Ash | 222/146.5 |
| 3,779,426 | 12/1973 | Mawby | 222/146.5 X |
| 3,851,801 | 12/1974 | Roth | 222/146.5 |
| 4,059,204 | 11/1977 | Duncan et al. | 219/230 X |
| 4,069,087 | 1/1978 | Lüke et al. | 219/230 X |
| 4,077,306 | 3/1978 | Wech | 226/143 X |

*Primary Examiner*—Joseph J. Rolla

*Assistant Examiner*—Frederick R. Handren

*Attorney, Agent, or Firm*—Charles E. Brown

[57] ABSTRACT

This relates to a dispenser for a hot melt material which is supplied in rod-like form from a spool and which is heated to the required semi-liquid dispensing state. The dispensing head is provided with a heating passage which provides for uniform heating of the rod-like hot melt material and there is further provided a special piston having a throughbore through which hot melt material is fed into a pumping cylinder as the piston retracts after a pumping stroke so as to eliminate in the dispensing head downstream of the piston any momentary voids. There is also a feed mechanism which will feed the hot melt material in accordance with the demand of the dispensing head and which will urge the rod-like hot melt material into the heating passage of the dispensing head under a preselected pressure so as to assure flow not only through the heating passage, but also through the piston. There are also provided means for detecting the existence of the rod-like hot melt material in advance of the feed mechanism to make certain that the apparatus be shut down when no hot melt material supply is available. There is also provided a reverse drive unit for retracting the previously fed hot melt material a short distance to relieve the build-up of pressure in the heating passage when the dispensing operation is momentarily shut down and heat is still being applied to the hot melt material disposed within the heating passage.

13 Claims, 8 Drawing Figures

HOT MELT MATERIAL DISPENSER

This invention is particularly directed to the dispensing of hot melt material which is applied in rod-like form and which is fed from a supply source to a dispensing head and, prior to being dispensed, is heated so that it is in a semi-liquid flowable form. In the past, hot melt material has been supplied in the rod-like form and has been heated by passage through a heater unit and then flows to a dispensing head in the semi-liquid fluid form. The prior arrangements have required a seal which has constantly posed problems.

In accordance with this invention, the hot melt material is heated by passage through a relatively elongated heating passage and is constantly fed into that heating passage substantially on demand only and under a predetermined pressure. Further, during periods of non-dispensing and non-feeding, the pressure applied on the rod-like material is relieved so that as the stationary hot melt material within the heating passage is heated to an extent which does not normally occur and expansion results, there is no resistance against backflow and there is no sealing problem.

Most particularly, in accordance with this invention, the rod-like hot melt material is fed at a preselected pressure by a pair of cooperating feed wheels which may be of a toothed construction, if so desired, to assure a positive driving of the rod-like material. Preferably, the feed wheels are driven by a drive unit which is responsive to the demands of an associated dispensing head. In the simplest form, the drive unit is a motor having a clutch disposed between the motor and the feed wheels with the clutch being preferably of the eddy current control type so that the rod-like hot melt material is fed toward the dispensing head at a preselected and controllable pressure.

In accordance with this invention, the drive for the feed wheels includes a second drive unit which, upon each stopping of the forward feeding of the rod-like hot melt material, is brought into operation reversely to rotate the feed wheels a short arcuate distance sufficient to retain the hot melt material in its relationship to a dispensing head, but at the same time sufficient to relieve internal pressures within the heating passage of the dispensing head so that there is no backflow or squeeze-out of the heated hot melt material. This second feed includes a swingably mounted drive shoe which, when actuated, will first move to contact a drive wheel and then will move generally tangential to that drive wheel to effect the desired reverse rotation of the feed wheels.

Another feature of the invention relates to the specifics of the dispensing head which includes a piston mounted within a pumping cylinder for dispensing preselected quantities of the hot melt material upon each actuation of the dispensing head. In order to avoid a vacuum in the discharge passage of the dispensing head when the piston retracts, the piston is provided with a through passage closed during the pumping operation by a check valve and flow into the pumping cylinder is through a side wall of the piston and into the through passage.

A further feature of the invention is the general configuration of the heating passage which gradually flattens and may be divided into several portions to assure a complete and uniform heating of the hot melt material so that the consistency of the hot melt material flowing into the pumping cylinder will be constant.

With the above and other objects in view that will hereinafter appear, the nature of the invention will be more clearly understood by reference to the following detailed description, the appended claims, and the several views illustrated in the accompanying drawings.

Figure 1:
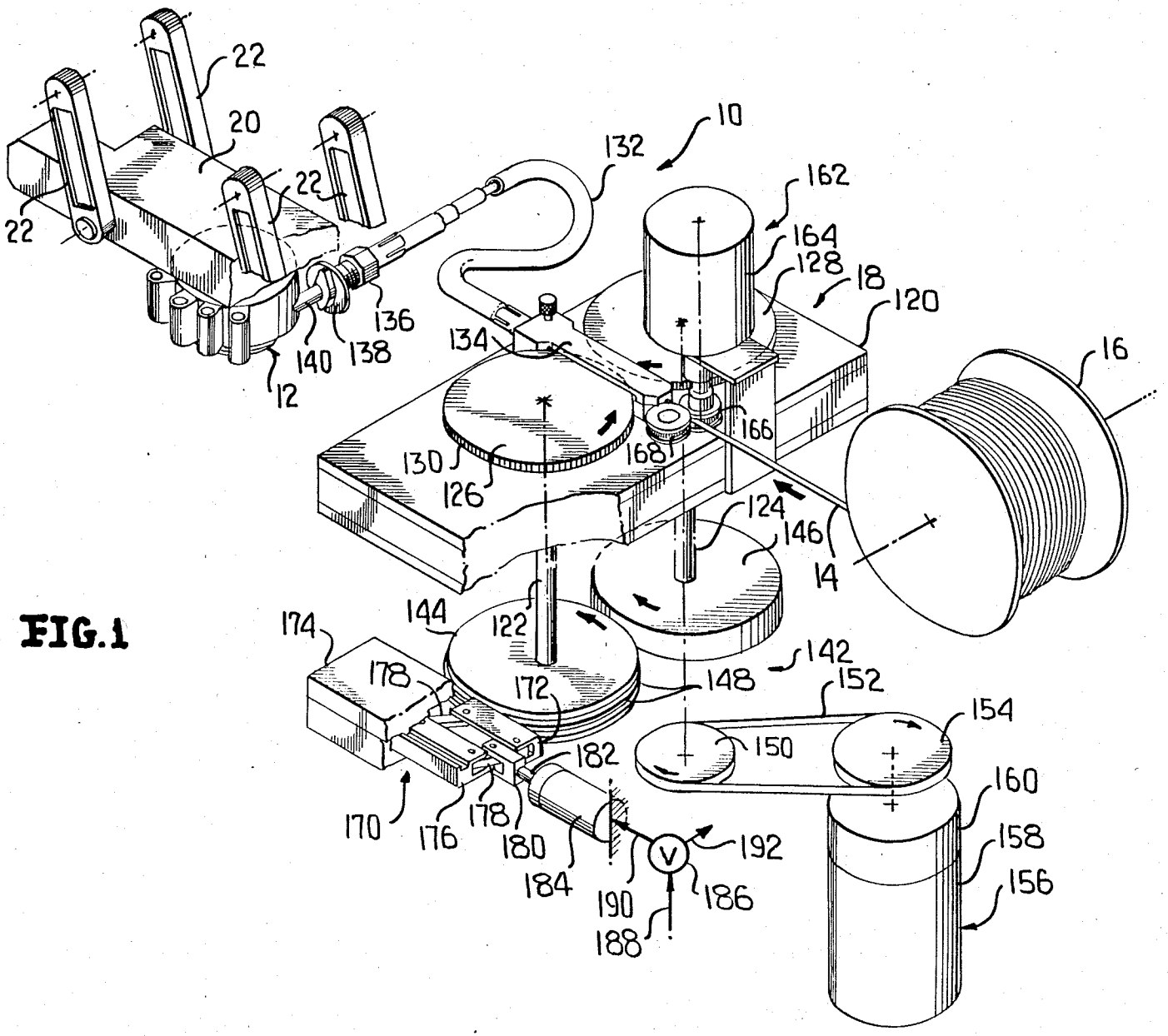
FIG. 1 is a schematic perspective view with parts broken away of a hot melt material dispenser in accordance with this invention.

Referring now to the drawings in detail, it will be seen that there is illustrated in FIG. 1 a hot melt material dispenser formed in accordance with this invention, the overall dispenser being generally identified by the numeral 10. The dispenser includes a dispensing head generally identified by the numeral 12. This dispensing head is mounted in the manner and actuated in the manner disclosed in our copending application Ser. No. 456,958, filed Jan. 10, 1983, and the dispensing head 12 is an improvement on the dispensing head of our above-identified application.

In accordance with this invention, hot melt material 14 in rod-like form is dispensed from a spool 16 through a feed mechanism generally identified by the numeral 18 to the dispensing head 12 in accordance with the demand of the dispensing head 12.

The invention will be best understood by first broadly describing the dispensing head and the mounting thereof. In accordance with one usage of the dispensing head, there is provided a carrier 20 which is mounted for movement in parallel planes by being suspended from four pivot arms 22 which are, in turn, pivotally suspended from a support (not shown). In the illustrated usage of the dispensing head 12, the dispensing head 12 is moved laterally together with container components to which the hot melt material is applied, with the hot melt material in this instance being in the form of an adhesive.

Figure 6:
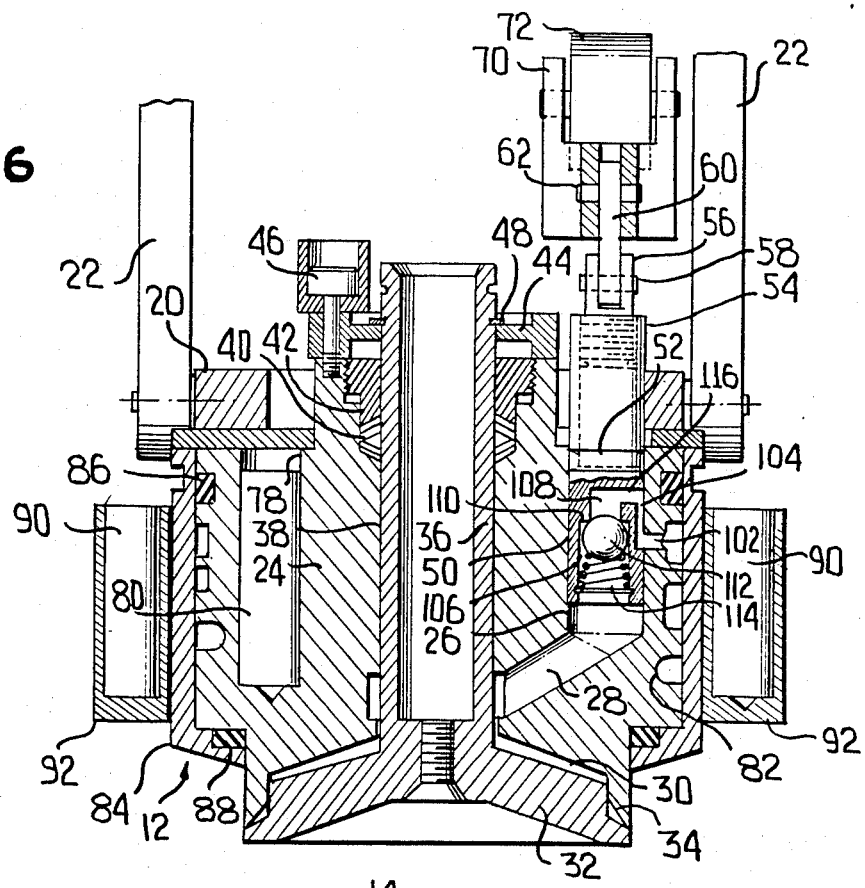
FIG. 6 is an enlarged fragmentary vertical sectional view through the dispensing head taken generally along the line 6—6 of FIG. 2.
Figure 7:
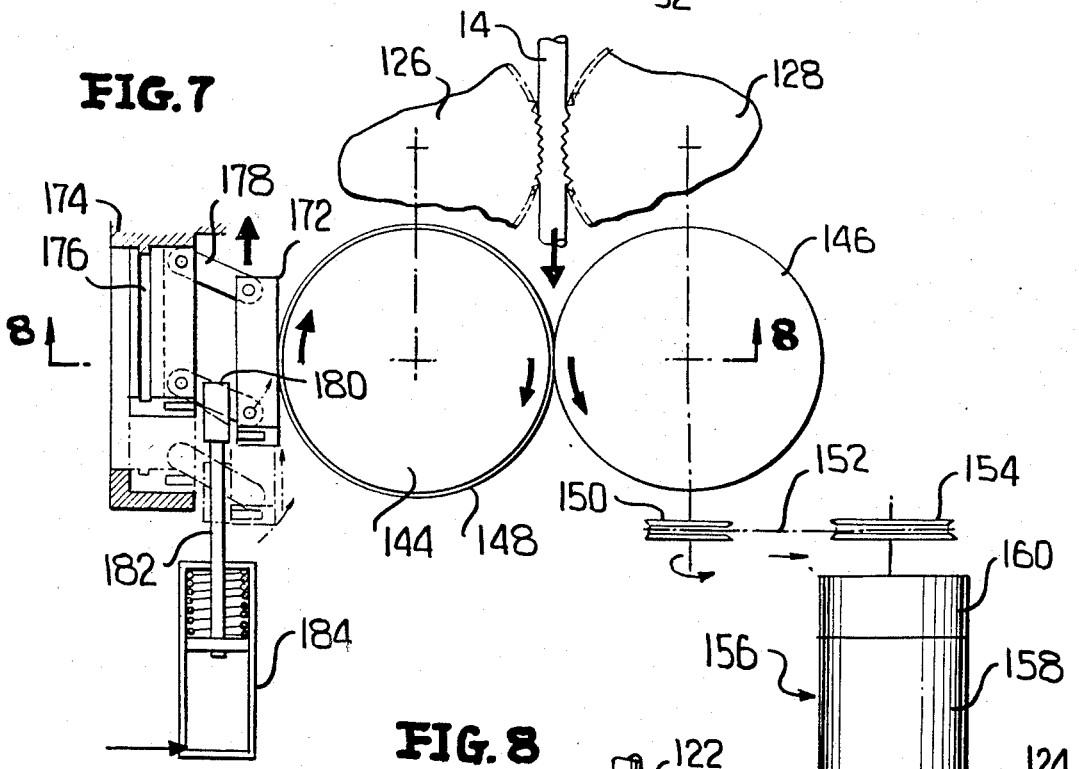
FIG. 7 is a schematic generally plan view with parts broken away and shown in section of the feed system for the hot melt material.
Figure 8:
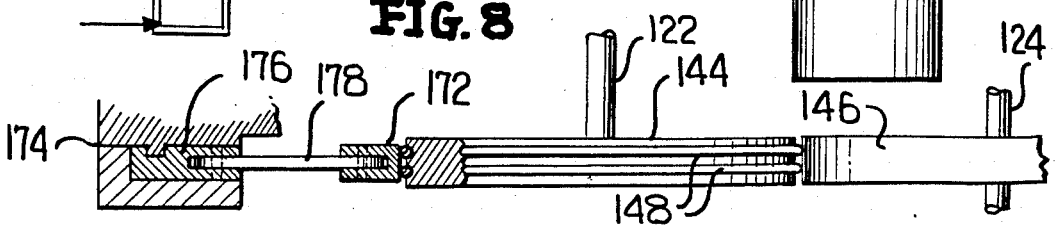
FIG. 8 is a fragmentary vertical sectional view taken generally along the line 8—8 of FIG. 7, and shows the specific details of the drive for the feed unit.

The dispensing head 12 is suitably carried by the carrier 20 as is broadly shown in FIG. 6, and includes a housing 24 which is fixed to the carrier 20 and which is provided with a pumping cylinder 26 which opens at its lower end in a passage 28 which, in turn, is in communication with a holding area 30 normally closed by a rigid valve member 32. The valve member 32 has a seal with the lower end of the housing 24 generally as at 34, and normally prevents discharge of the hot melt material, which is in semi-liquid form, from the holding area 30.

The valve 32 has a valve stem 36 which extends entirely through the housing 24 by way of a bore 38 in the housing 24, with the valve stem 36 being sealed with respect to the upper part of the bore 38 by a gasket or sealing ring 40 which is compressed by means of a compression member 42 which is threaded into the upper part of the housing 24.

The upper part of the housing 24 has seated thereon a spring member 44 which is secured in place by suitable fasteners 46. The valve stem 36 passes through the center of the spring member 44 and is provided with a locking ring 48 which bears against the upper surface of a central portion of the spring member 44 so that the spring member 44, in its normal position, holds the valve member 32 in a closed position.

Figure 2:
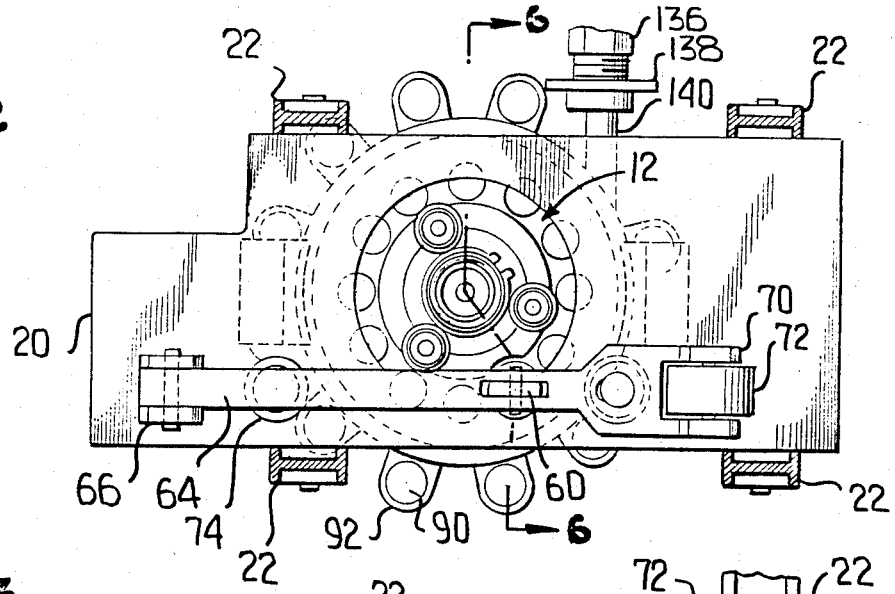
FIG. 2 is a plan view of a dispensing head and an actuator therefor in accordance with this invention.
Figure 3:
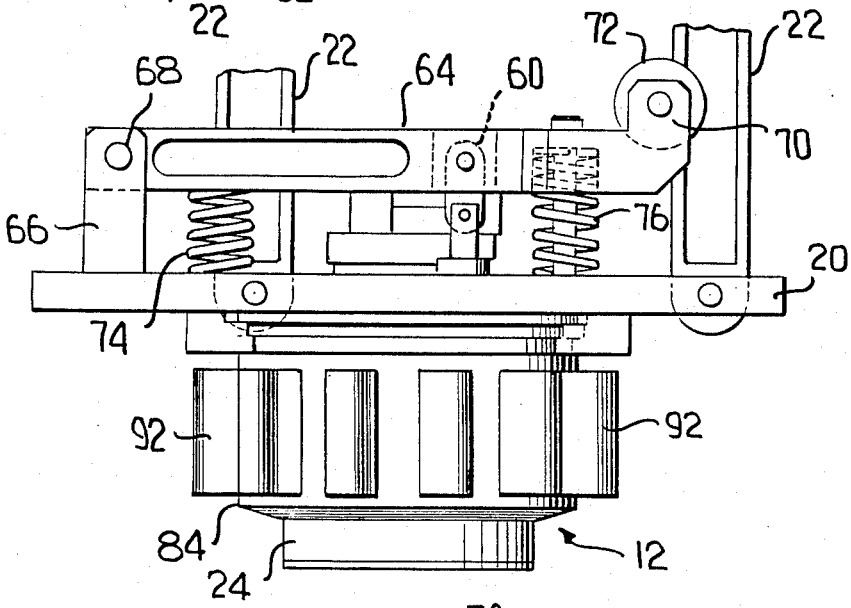
FIG. 3 is an elevational view of the dispensing head and mounting of FIG. 2.

The pumping cylinder 26 is provided with a piston 50 which has a piston rod 52 extending vertically therefrom, and the piston rod 52, in turn, has adjustably connected thereto an actuator 54 which is provided at its upper end with a bifurcated part 56 to which there is pivotally connected by means of a pivot pin 58 a link 60. The upper end of the link 60 is, in turn, pivotally connected by way of a pivot pin 62 to a bifurcated part of an actuating arm 64 which is best illustrated in FIGS. 2 and 3. The arm 64 has one end thereof pivotally mounted on a support stand 66 by way of a pivot 68, and has a bifurcated offset opposite end 70 which carries a cam follower 72. The arm 64 is normally retained in the position shown in FIGS. 2, 3 and 6 by way of springs 74, 76. A rotating cam (not shown) periodically moves the cam follower 72 down so as to pivot the arm 64 downwardly about the pivot pin 68 and thus move the piston 50 down in the pumping cylinder 26 to supply additional semi-liquid hot melt material to the holding chamber 30 under pressure which results in a temporary downward movement of the valve member 32 under the resistance of the spring member 44 to dispense in an annular pattern a preselected amount of the hot melt material.

In accordance with this invention, the housing 24 is provided with a plurality of circumferentially spaced vertical bores 78 in which there are seated suitable electrical heaters 80. The heaters 80 serve to heat the housing 24 to a uniform preselected temperature.

Also in accordance with this invention, the housing 24 has formed in the outer periphery thereof a heating passage 82 into which the rod-like hot melt material 14 is fed in a solid state and wherein, as the hot melt material passes through the heating passage, the hot melt material is gradually and uniformly heated to a desired dispensing temperature wherein it is in generally liquid or semi-liquid form.

Preferably, the heating passage 82 is machined or otherwise formed in the exterior of the housing 20 per se, and the housing 24 is seated in a jacket 84 which tightly engages the outer surface thereof in sealed relation to form the outer surface of the heating passage 82. The jacket 84 is sealed relative to the exterior of the housing 24 by a pair of vertically spaced sealing rings 86, 88.

Further, the jacket 84 has suitably mounted on the exterior thereof other heating elements 90 which may be suitably seated in holders 92 which are connected to the exterior surface of the jacket 84 in conducting relation.

Figure 5:
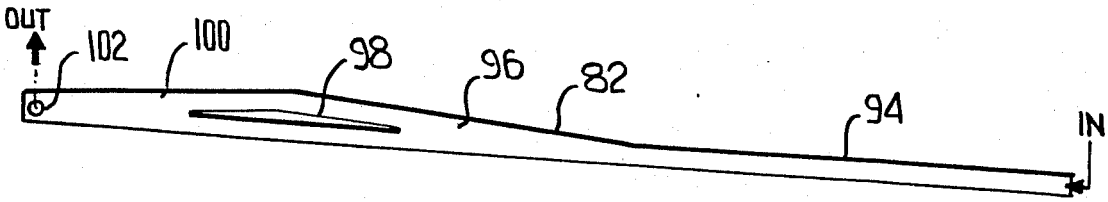
FIG. 5 is a developed view of the heating passage.

The heating passage 82 is believed to be unique in that, as is best shown in FIG. 5, it has a leading portion 94 thereof which is generally circular in cross section so as to match the cross section of the rod-like configuration of the hot melt material. Thereafter, the heating passage 82 has a portion 96 which increases in width and, as is best shown in FIG. 6, decreases in its radial dimension or thickness so that the hot melt material which has been heated to a deformation temperature will flatten out and permit more uniform heating thereof. The flaring portion 96 has positioned therein one end of a divider 98 which serves to divide the hot melt material passing through the heating passage 82 into two separate passages, thereby more effectively and uniformly to heat the hot melt material. The heating passage 94 terminates in a portion 100 which tapers in width and increases in thickness.

It is to be noted that the heating passage terminates adjacent a radial discharge orifice 102 which, as is best shown in FIG. 6, opens into an upper part of the pumping cylinder 26 in opposed relation to the piston 50. It is through this orifice 102 that the now sufficiently heated and generally liquid hot melt material is directed into the pumping area of the dispensing head 12.

In FIG. 6 the piston 50 is illustrated as having an entrance opening 104 in the outer wall thereof with the entrance opening 104 being axially elongated. The piston 50 is provided with a through passage defined by a large diameter lower bore 106 and a smaller diameter upper bore 108 with an intermediate shoulder 110 therebetween defining a valve seat for a ball 112 of a check valve 114 which is of the spring loaded type. It will be seen that the entrance opening 104 is connected to the upper end of the bore 108 by means of a radial passage 116.

Figure 4:
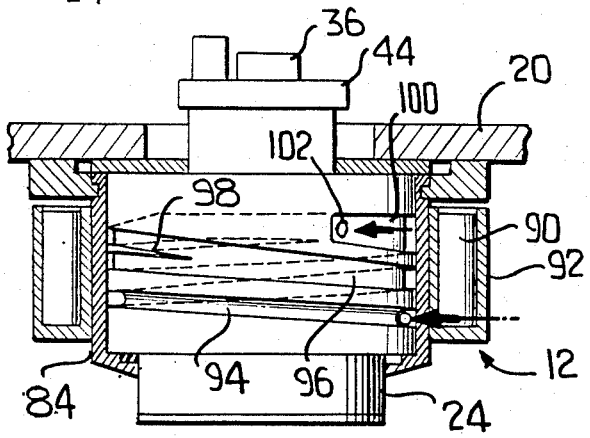
FIG. 4 is a schematic view with parts broken away, showing the general arrangement of the heating passage of the dispensing head.

It is to be understood that the heating passage 82 extends generally spirally around the housing 24, as is best shown in FIG. 4, so that the hot melt material is heated sufficiently to flow through the piston 50, unseating the check valve ball 112 and permitting the flow of hot melt material into the passage 28 and holding area 30. Thus, at the end of a dispensing operation, as the piston 50 is urged upwardly by the reaction of the springs 74, 76 on the arm 64, in lieu of a vacuum being drawn in the passage 28 or at the lower end of the pumping cylinder 26, the heated hot melt material, which is under pressure within the heating passage 82 for a reason to be described hereinafter, will flow through the piston 50 and eliminate any voids in the hot melt material within the housing 24. It will be seen that since the lower part of the pumping cylinder 26, the passage 28 and the holding area 30 will all be filled with the hot melt material at the time of the next stroke of the piston 50, there will be a substantially immediate closing of the piston 50 against flow of hot melt material therethrough, and the piston will function in a normal manner.

Referring once again to FIG. 1, it will be seen that the feed mechanism 18 includes a support housing 120 in which there is journalled two shafts 122, 124. The upper end of the shaft 122 carries a feed wheel 126 while the upper end of the shaft 124 carries a companion feed wheel 128. It is to be understood that the feed wheels may have toothed peripheries 130 and are in cooperating relation so as to have passed therebetween, but gripped thereby, the hot melt material 14 in its rod-like form. The feed wheels 126, 128, when rotated, serve to feed the hot melt material into a flexible tube 132 through an entrance guide unit 134 which also serves to maintain the rod-like material between the feed wheels 126, 128. The tube 132 has the other end thereof anchored generally as at 136 to a fitting 138 which is carried by a tube 140 which leads into the heating passage 82.

The feed wheels 126, 128 are driven in unison by a drive unit generally identified by the numeral 142 which includes a pair of drive wheels 144, 146. The drive wheel 144 carries about the periphery thereof friction rings or belts 148 which are compressed against the peripheral surface of the drive wheel 146 to drivingly connect together the driving wheels 144, 146.

An extension of the shaft 124 below the drive wheel 146 carries a pulley 150 which is connected by way of a flexible drive element or belt 152 to a drive pulley 154. The drive pulley 154 is carried by and driven by a drive motor unit 156.

In the preferred embodiment of the invention, the drive motor unit 156 will include an electric motor 158 having coupled thereto a clutch 160 which is preferably an eddy current clutch is set to operate only when the resistance of the feed wheels 126, 128 to driving is below a predescribed torque. In this manner, the rod-like hot melt material 14 is forcibly pushed through the tube 132 into the heating passage 82 under a preselected pressure. When there is insufficient demand for the hot melt material at the dispensing head, then the clutch 160 will slip.

At this time it is pointed out here that consideration has been given to the utilization of a pulse motor instead of the continuously rotating motor 158. The pulse motor would be actuated in accordance with the actuation of the dispensing head 12 so as to feed the hot melt material to the dispensing head 12 in accordance with the output of the dispensing head.

In order that the equipment of the dispensing head 12 will not operate without an adequate supply of the hot melt material 14, there is provided a detector system 162 for controlling the operation of the apparatus in the absence of a supply of the hot melt material to the feed wheels 126, 128. To this end, there is an electrical rotary detector unit 164 which carries an actuator wheel 166 which is driven by the moving hot melt material. There is associated with the actuator wheel 166 a backup wheel 168, and these two wheels may have toothed peripheries so as to assure the driving of the wheel 166. The detector unit 164 will have electrical connections (not shown) which will cause a shutdown of the apparatus when there is no indication of the hot melt material being fed and the operation of the apparatus calls for the feeding of the hot melt material.

It will be obvious from the foregoing that as the hot melt material is constantly fed into the heating passage 82, there will be a gradual heating of the hot melt material so that at some point along the length of the heating passage 82 the hot melt material will obtain the required semi-liquid state. On the other hand, all of the hot melt material within the heating passage 82 is subjected to heat. Thus, when there is a shutdown of the dispensing operation of the dispensing head 12, accompanied by a discontinuation of the feeding of the hot melt material to the dispensing head, the hot melt material already fed into the heating passage 82 will, in the leading portions of the heating passage 82, become heated to a greater extent to or generally toward the semi-liquid state. Since the hot melt material expands when heated, this will result in an undesirable back pressure within the heating passage 82. To alleviate this situation, the feed mechanism 18 is provided with a further drive unit generally identified by the numeral 170 which serves to reverse the direction of rotation of the feed wheels 126, 128 through a limited arc, withdrawing the hot melt material relative to the heating passage 82. The feed unit 170 operates in conjunction with the drive wheel 144 and includes a shoe 172 which engages the friction rings 148 to drive the drive wheel 144 in a direction opposite to that in which it is driven by the motor unit 156.

It will be seen that the shoe 172 is mounted relative to a support 174 on a slide member 176 which is slidable in the support 174 along a line spaced from and parallel to a tangent to the periphery of the feed wheel 144. The slide member 176 carries a pair of links 178 which are pivotally connected to both the slide member 176 and the shoe 172 so that the shoe 172 is mounted for movement toward and away from the drive wheel 144 parallel to the slide member 176.

A bifurcated fitting 180 carried by a piston rod 182 of a linear fluid cylinder 184 is pivotally connected to one of the linkages 178. When the fluid motor 184 is actuated, it serves first to pivot the linkage 178 to move the shoe 172 into engagement with the drive wheel 144 and thereafter the slide member 176, the linkage 178 and the shoe 172 move as a unit relative to the support 174, thereby rotating the drive wheel 144.

In the preferred embodiment of the invention, the linear motor 184 is in the form of a single acting spring loaded air cylinder whose operation is controlled by a valve 186 for supplying compressed air from an air source 188 through a line 190 to the air cylinder and exhausting the same through an exhaust line 192. When the apparatus is shut down, the valve 186 will be automatically opened.

From the foregoing it will be seen that there has been provided in conjunction with a dispensing head heating means for uniformly heating the hot melt material to the required semi-liquid dispensing state and that there has also been provided a feed mechanism for supplying the hot melt material in rod-like form in accordance with the demand rate of the dispensing head so that it may be suitably heated in the heating passage without the need for the complex seals previously required. Further, it will be seen that there has been provided means for compensating for the non-operation of the dispensing head while heat is still being applied to the fed hot melt material which results in an undue expansion and back pressure within the heating passage so that there is no expulsion of the hot melt material from the heating passage.

Although only a preferred embodiment of the hot melt material dispenser has been specifically illustrated and described herein, it is to be understood that minor variations may be made therein without departing from the spirit and scope of the invention as defined by the appended claims.

We claim:

1. A hot melt material dispenser comprising a housing, supply means connected to said housing for supplying to said housing a continuous supply of hot melt material in solid rod-like form, heater means carried by said housing for heating said hot melt material to a fluid state, a cylinder in said housing, a piston in said cylinder, an actuator connected to said piston for moving said piston in said cylinder to pump flowable hot melt material from said cylinder, said piston having a pressure end portion which is hollow, a radially opening external opening through said piston into said hollow pressure end portion for delivering hot melt material through said piston into said cylinder below said piston, and a flow passage into said cylinder radially towards said piston for radial hot melt material flow through said radial opening into said piston in an at rest position of said piston.

2. A hot melt material dispenser according to claim 1 wherein there is an automatic check valve for closing said piston hollow end portion during pumping movement of said piston.

3. A hot melt material dispenser according to claim 1 wherein said supply means includes means for supplying hot melt material to said cylinder under pressure.

4. A hot melt material dispenser according to claim 3 wherein there are heater means associated with said housing for heating the hot melt material, said means for supplying hot melt material includes positive feed means, and means for reversing said positive feed means at the end of each feeding operation to compensate for expansion of fed hot melt material.

5. A hot melt material dispenser according to claim 4 wherein said positive feed means includes a pair of cooperating wheels, first drive means for driving said wheels in a feed direction, and second feed means for driving said wheels in a reverse direction.

6. A hot melt material dispenser according to claim 5 wherein said second means includes a drive wheel, a shoe for engaging said drive wheel, link means pivotally mounting said shoe for movement into engagement with said drive wheel, and a drive unit connected to said shoe for both pivoting said shoe and advancing said shoe.

7. A hot melt material dispenser according to claim 6 together with a movable support for said link means for permitting said link means and said shoe to advance as a unit after said shoe engages said drive wheel.

8. A hot melt material dispenser comprising a dispensing head including heater means for heating solid hot melt material in a rod-like form to a flowable state, a piston and cylinder arrangement for receiving and dispensing flowable hot melt material, and supply-means for supplying the holt melt material in melted rod-like form to said cylinder under pressure, said supply means including a feed unit, said feed unit including a pair of opposed feed wheels for receiving therebetween in gripping relation the rod-like hot melt material, and a drive unit drivingly connected to said feed wheels for advancing the hot melt material in accordance with the demand of said piston and cylinder arrangement, pressure releasing means for reversing the rotation of said feed wheels at the end of each use of said dispensing head to relieve the pressure on the fed hot melt material and thus allow expansion of hot melt material under the influence of said heater means.

9. A hot melt material dispenser according to claim 8 wherein said drive unit includes a pair of rotary drive members with one of said rotary drive members being coupled to each of said feed wheels for rotating the same, and at least one of said rotary drive members having friction means on the periphery thereof for enhancing driving engagement between said rotary drive members, and said pressure releasing means being engageable with said friction means of said at least one rotary drive member.

10. A hot melt adhesive dispenser according to claim 9 wherein said pressure releasing means includes a support mounted for movement along a line generally parallel to a tangent to said at least one rotary drive member, a shoe, linkage pivotally mounting said shoe on said support for movement toward and away from said support and generally parallel thereto, and a linear actuator for moving said shoe relative to said support to engage said at least one rotary drive member and to thereafter move said support, said linkage and said shoe as a unit to rotate said rotary drive members.

11. A hot melt material dispenser comprising a housing, supply means connected to said housing for supplying to said housing a continuous supply of hot melt material in solid rod-like form, heater means carried by said housing for heating said hot melt material to a fluid state, dispensing means carried by said housing for receiving said hot melt material in said fluid state and dispensing said hot melt material, said supply means including means for supplying hot melt material to said dispensing means under pressure including positive feed means and means for reversing said positive feed means to withdraw said hot melt material at the end of each feeding operation to compensate for expansion of fed hot melt material, said positive feed means including a pair of cooperating wheels, first drive means for driving said wheels in a feed direction, and second drive means for driving said wheels in a reverse direction.

12. A hot melt material dispenser according to claim 11 wherein said second means includes a drive wheel, a shoe for engaging said drive wheel, link means pivotally mounting said shoe for movement into engagement with said drive wheel, and a drive unit connected to said shoe for both pivoting said shoe and advancing said shoe.

13. A hot melt material dispenser according to claim 12 together with a movable support for said link means for permitting said link means and said shoe to advance as a unit after said shoe engages said drive wheel.

* * * * *